US009695612B2

(12) United States Patent
Batts, III

(10) Patent No.: US 9,695,612 B2
(45) Date of Patent: Jul. 4, 2017

(54) ALUMINUM FENCE DESIGN

(71) Applicant: William Alexander Batts, III, New Haven, CT (US)

(72) Inventor: William Alexander Batts, III, New Haven, CT (US)

(73) Assignee: Porcelen Limited Connecticut LLC, Hamden, CT (US)

( * ) Notice: Subject to any disclaimer, the term of this patent is extended or adjusted under 35 U.S.C. 154(b) by 0 days.

(21) Appl. No.: 15/171,462

(22) Filed: Jun. 2, 2016

(65) Prior Publication Data

US 2017/0044793 A1 Feb. 16, 2017

Related U.S. Application Data

(60) Provisional application No. 62/203,075, filed on Aug. 10, 2015.

(51) Int. Cl.
*E04H 17/14* (2006.01)

(52) U.S. Cl.
CPC . *E04H 17/1439* (2013.01); *E04H 2017/1452* (2013.01)

(58) Field of Classification Search
CPC ..... E04H 17/1417; E04H 17/1421; E04H 17/1439; E04H 17/20; E04H 2017/1452; E04H 2017/1465; E04H 2017/1469
USPC ..... 256/65.01, 65.02
See application file for complete search history.

(56) References Cited

U.S. PATENT DOCUMENTS

| | | | | |
|---|---|---|---|---|
| 5,454,548 | A | 10/1995 | Moore | |
| 6,173,944 | B1 | 1/2001 | McCarthy | |
| 6,375,166 | B1 | 4/2002 | Schall et al. | |
| D479,612 | S | 9/2003 | Larsen et al. | |
| 6,752,386 | B1 | 6/2004 | Bundy | |
| 6,969,051 | B1 | 11/2005 | Gibbs | |
| 7,021,607 | B1 | 4/2006 | Alexander | |
| 7,347,412 | B1 | 3/2008 | Zhu | |
| 7,384,025 | B2 | 6/2008 | Lo | |
| 8,413,332 | B2 | 4/2013 | Duffy et al. | |
| 8,413,965 | B2 | 4/2013 | Duffy et al. | |
| 8,695,949 | B2 * | 4/2014 | Stinson | E04H 17/143 256/64 |
| 9,027,909 | B1 * | 5/2015 | Peyton | E04H 17/1439 256/67 |
| 9,404,283 | B1 * | 8/2016 | Lo | E04H 17/1439 |
| 2010/0200827 | A1 | 8/2010 | Duffy et al. | |
| 2013/0264532 | A1 | 10/2013 | Goodman | |

* cited by examiner

*Primary Examiner* — Josh Skroupa
(74) *Attorney, Agent, or Firm* — Fay Sharpe LLP

(57) ABSTRACT

A fence having one or more horizontal rails with one or more apertures extending through the one or more horizontal rails, one or more vertical pickets, each of the one or more vertical pickets passing through the one or more apertures, each of the one or more vertical pickets having one or more openings and having one or more walls, and one or more retaining elements fixed within a horizontal rail, each of the one or more retaining elements having a base portion and one or more protrusions, the one or more protrusions engaged with the one or more openings in the one or more vertical pickets to secure the one or more vertical pickets to the one or more horizontal rails. The vertical pickets are fixed against lateral or transverse movement relative to the horizontal rails, and rotatable relative to the horizontal rails.

16 Claims, 7 Drawing Sheets

ALUMINUM FENCE DESIGN

CROSS REFERENCE TO RELATED PATENTS AND APPLICATIONS

This application claims priority to and the benefit of the filing date of U.S. Provisional Patent Application Ser. No. 62/203,075, filed Aug. 10, 2015, which application is hereby incorporated by reference.

BACKGROUND

Fences having intersecting vertical pickets and horizontal rails have recently become popular and are strong, durable and attractive, while requiring little or no maintenance. In most fence designs, fences use fasteners, such as screws, to fix a plurality of horizontal rails to a plurality of vertical pickets. A disadvantage to these designs that use fasteners is that the fasteners often rust and corrode. Further, it is difficult to assemble fences using screws, as it is hard to tighten the screws in the rails to attach the rails to vertical pickets. Moreover, if screws are used, then the fence cannot rotate, thus, making it difficult to set the fences on uneven surfaces.

There are various designs for fences having vertical pickets and horizontal rails known in the prior art. U.S. Pat. No. 7,384,025 to Lo, U.S. Pat. No. 7,347,412 to Zhu and U.S. Pat. No. 6,173,944 to McCarthy all have screws engaging the coupling bars. While the screws are hidden in these designs, these designs suffer from having the screws rust and corrode, and these fence designs are difficult to assemble.

U.S. Pat. No. 5,454,548 to Moore is a fence design having a solid coupling bar with locking means that firmly locks the rails into pickets forming a rigid structure and thus not enabling any rotation of the rails with the pickets or posts. U.S. Pat. No. 6,375,166 to Schall et al. uses inserts with legs for attachment; U.S. Pat. No. D479,612 to Larsen et al. and U.S. Pat. No. 6,969,051 to Gibbs use a locking rod; U.S. Pat. No. 7,021,607 to Alexander uses clips having flaps for attachment; and U.S. Pat. No. 6,752,386 to Bundy uses a sliding lockbar for attachments to a fence assembly.

A screwless retaining bar for a fence assembly is disclosed in U.S. Patent Publication No. 2013/0264532, which is hereby incorporated by reference in its entirety. The retaining element allows the vertical pickets of the fence to rotate with respect to the horizontal rails of the fence so that the fence can be installed on an uneven surface.

BRIEF DESCRIPTION

While the screwless retaining bar described in U.S. Patent Publication No. 2013/0264532 represents an advance in the art, still further improvements are set forth in the present disclosure. For example, in one embodiment a screwless retaining bar is configured to be fixed in place within the horizontal bar and the vertical bars are configured to rotate about respective protrusions of the screwless retaining bar.

In accordance with one aspect of the present disclosure, a fence comprises one or more horizontal rails, each of the one or more horizontal rails having one or more apertures extending through the one or more horizontal rails, one or more vertical pickets, each of the one or more vertical pickets passing through the one or more apertures, each of the one or more vertical pickets having one or more openings and having one or more walls, and one or more retaining elements fixed within a horizontal rail, each of the one or more retaining elements having a base portion and one or more protrusions, the one or more protrusions engaged with the one or more openings in the one or more vertical pickets to secure the one or more vertical pickets to the one or more horizontal rails. The one or more vertical pickets are fixed against lateral or transverse movement relative to the one or more horizontal rails, and rotatable relative to the one or more horizontal rails.

In an embodiment, the one or more horizontal rails can include a first support ridge extending along a length thereof, the support ridge having a gap therein, and wherein the retaining element includes a tab that is received in the gap thereby restricting longitudinal displacement of the retaining element relative to the horizontal rail. The one or more horizontal rails can include a second support ridge extending along a length thereof and spaced apart from the first support ridge, and wherein the retaining element is received between the first and second support ridges along a major portion of its length, whereby the retaining element is restricted from transverse movement relative to the horizontal rail. The first support ridge can include a first portion extending perpendicular from the horizontal rail, and a distal angled edge portion extending from the first portion in a direction towards the second support ridge, whereby the distal angled edge portion traps the retaining member against an adjacent surface of the horizontal rail. At least a portion of the retaining element can have a wedge-shape cross-section including opposite parallel edges, a back edge extending perpendicularly between said opposite parallel edges, and a front edge extending at an acute angle relative to the back edge between said opposite parallel edges. The front edge of the retaining element can extend at a common angle with the distal angled edge portion of the first support ridge. The front edge portion and the distal angled edge portion of the first support ridge can be coextensive.

The one or more vertical pickets can be rotatable relative to the one or more horizontal rails, the extent of said rotation being limited by interference with portions of the one or more horizontal rails surrounding the one or more apertures. The one or more apertures can be rectangular apertures having a length along the longitudinal direction of the horizontal rail that is greater than a width of the one or more vertical pickets. The length of the one or more apertures can be at least 1.5 times the width of the one or more vertical pickets.

In accordance with another aspect, a retaining element for a fence comprises a base portion including a wedge-shape cross-section having opposite parallel edges, a back edge extending perpendicularly between said opposite parallel edges, and a front edge extending at an acute angle relative to the back edge between said opposite parallel edges, a plurality of spaced-apart protrusions extending horizontally from a surface of the base portion including the front edge, and a tab extending vertically from a surface of the base portion including one of the parallel edges. The plurality of protrusions can be circular in cross-section.

In accordance with another aspect, a method of installation of a modular fence comprises the steps of providing one or more one or more horizontal rails, each of the one or more horizontal rails having one or more apertures extending through the one or more horizontal rails, providing one or more vertical pickets, each the one or more vertical pickets having one or more openings, providing one or more retaining elements, each of the one or more retaining elements having a base portion with one or more protrusions and a tab, disposing each of the one or more vertical pickets through one of the apertures extending through the one or more horizontal rails, disposing the one or more retaining elements within the one or more horizontal rails with the tab positioned in a gap of a support ridge of the horizontal rail, and engaging the one or more protrusions of the one or more retaining elements with the one or more openings in the one or more vertical pickets to fix the one or more vertical pickets to the one or more horizontal rails while permitting relative rotation between one or more horizontal rails and the one or more vertical pickets.

In an embodiment, the one or more horizontal rails can include a first support ridge extending along a length thereof, the support ridge having a gap therein, and wherein the retaining element includes a tab that is received in the gap thereby restricting longitudinal displacement of the retaining element relative to the horizontal rail. The one or more horizontal rails can include a second support ridge extending along a length thereof and spaced apart from the first support ridge, and wherein the retaining element is received between the first and second support ridges along a major portion of its length, whereby the retaining element is restricted from transverse movement relative to the horizontal rail. The first support ridge can include a first portion extending perpendicular from the horizontal rail, and a distal angled edge portion extending from the first portion in a direction towards the second support ridge, whereby the distal angled edge portion traps the retaining member against an adjacent surface of the horizontal rail. At least a portion of the retaining element can have a wedge-shape cross-section including opposite parallel edges, a back edge extending perpendicularly between said opposite parallel edges, and a front edge extending at an acute angle relative to the back edge between said opposite parallel edges. The front edge of the retaining element can extend at a common angle with the distal angled edge portion of the first support ridge.

DETAILED DESCRIPTION

Figure 1:
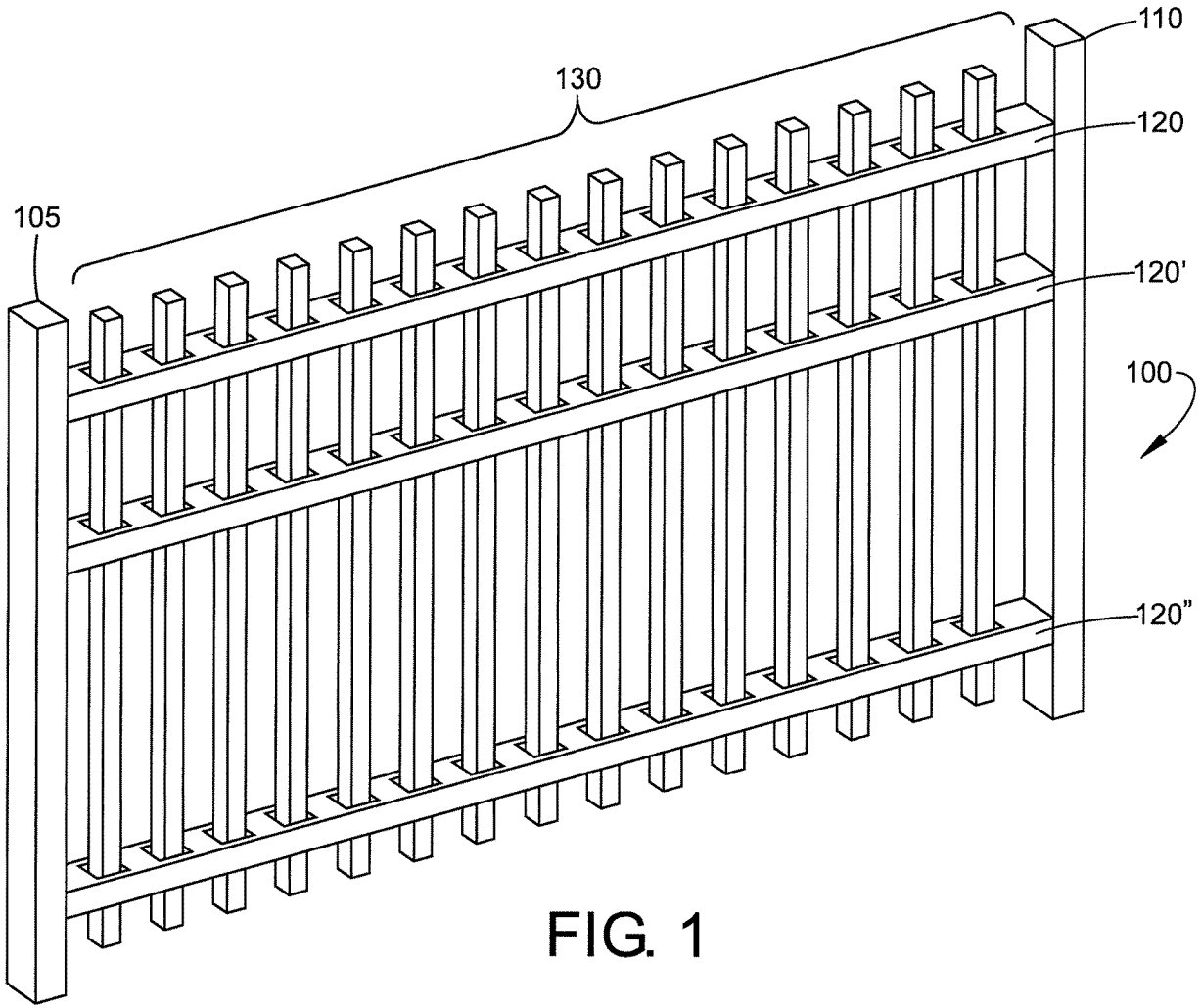
FIG. 1 is a perspective view of a fence of an exemplary embodiment of the present disclosure.

With reference to FIG. 1, a fence assembly 100 in accordance with the present disclosure is shown. The fence assembly 100 has vertical pickets 130 and horizontal rails 120, 120' and 120". Also shown are end posts 105 and 110. The assembly may have a greater number or a smaller number of horizontal rails and/or vertical pickets than shown in FIG. 1.

Figure 2:
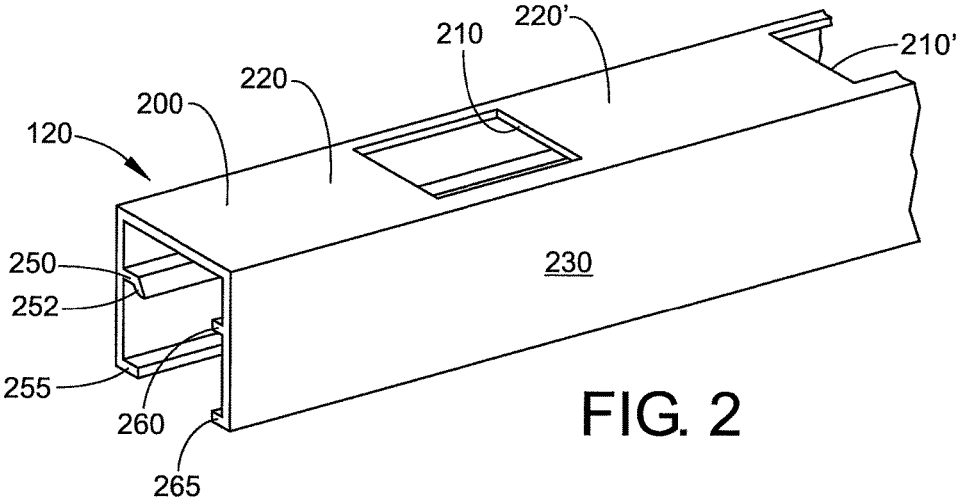
FIG. 2 is a perspective view of a horizontal rail of the embodiment of FIG. 1.

FIG. 2 is a perspective view of horizontal rail 120 of FIG. 1. FIG. 2 shows horizontal rail 120 having top surface 200, which is divided into sections 220 and 220' by apertures 210 and 210' extending through horizontal rail 120. Also shown are side surface 230 and the internal components of the rail. Upper support ridges 250 and 260 and lower support ridges 255 and 265 are shown in FIG. 2. These support ridges are shown extending horizontally or into the center of the interior of horizontal rail 120. Upper support ridge 250 includes a downwardly angled edge 252 that extends towards the lower support ridges 255 and 265.

Figure 3:
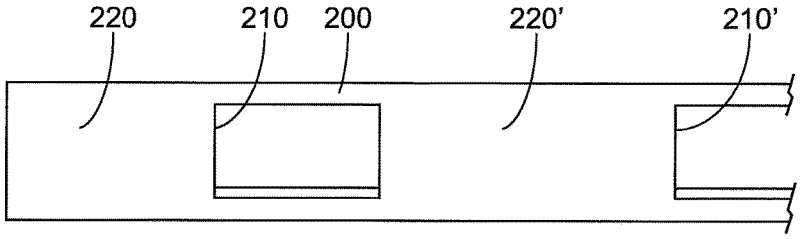
FIG. 3 is a top view of the horizontal rail of FIG. 2.
Figure 4:
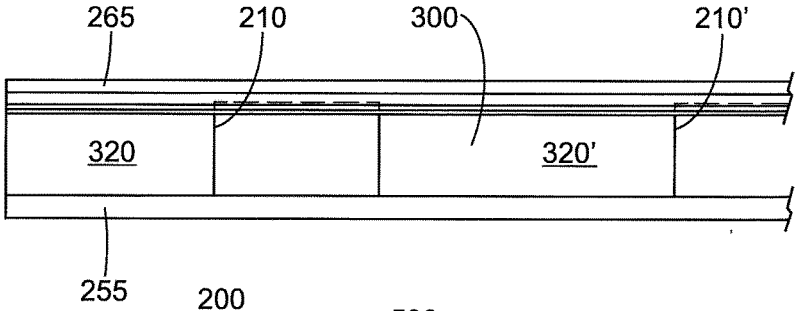
FIG. 4 is a bottom view of the horizontal rail of FIG. 2.
Figure 5:
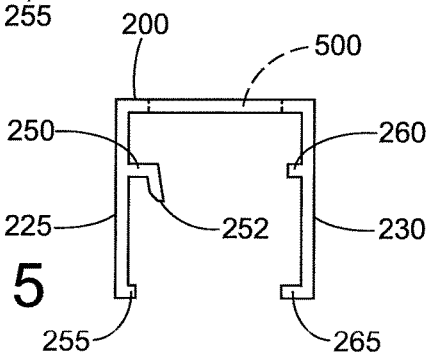
FIG. 5 is an end view of the horizontal rail of FIG. 2.

FIGS. 3-5 show other views of horizontal rail 120. Shown in these figures are apertures 210 and 210', although additional apertures may be present in a horizontal rail. Also shown is the bottom surface 300 of the horizontal rail 120, which is divided into sections 320 and 320' by apertures 210 and 210' extending through horizontal rail 120. Also shown is a side view of horizontal rail 120, side faces 225/230 and top face 500.

Figure 6:
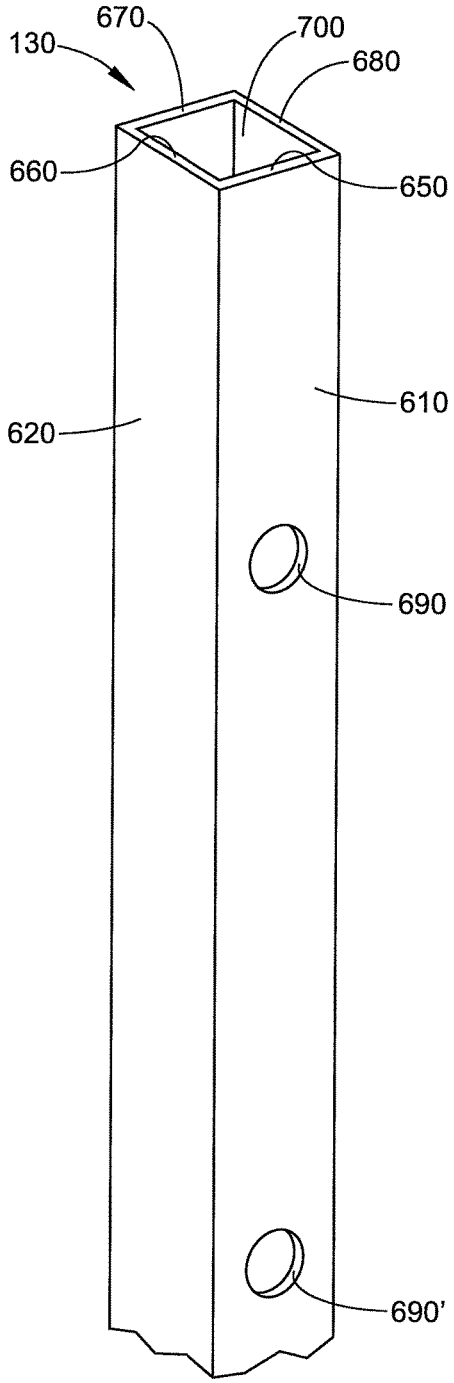
FIG. 6 is a perspective view of a vertical post of the embodiment of FIG. 1.

FIG. 6 is a perspective view of vertical picket 130. Vertical picket 130 is shown having side surfaces 610, 620 and two other surfaces which are not numbered. The top of the vertical picket is shown having sides 650, 660, 670 and 680. Also openings 690 and 690' are shown. These openings are shown being circular, although the openings may be other shapes such as being round, rectangular, oval, pentagonal, or may be additional shapes.

Figure 7:
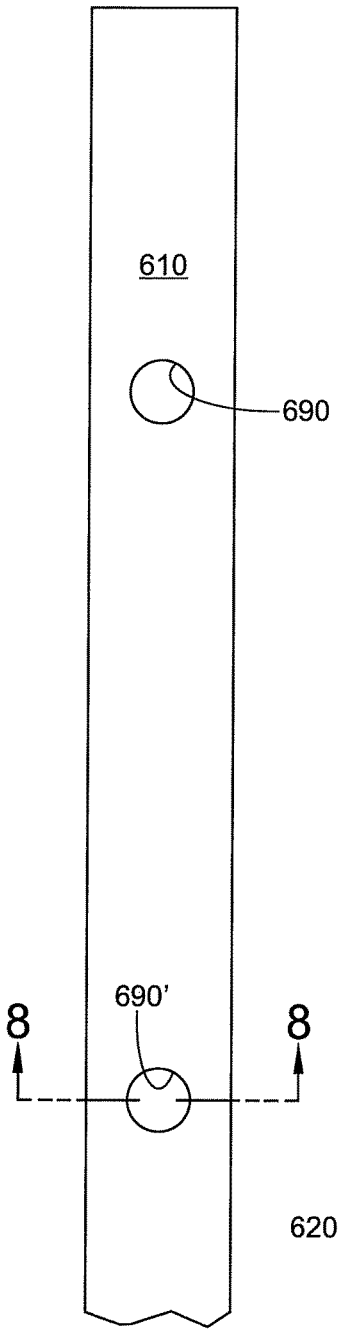
FIG. 7 is a side view of the vertical post of FIG. 6.
Figure 8:
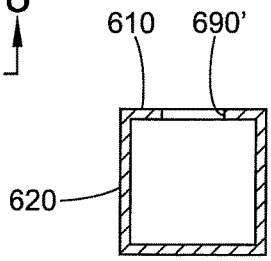
FIG. 8 is top view of the vertical post of FIG. 6.
Figure 9:
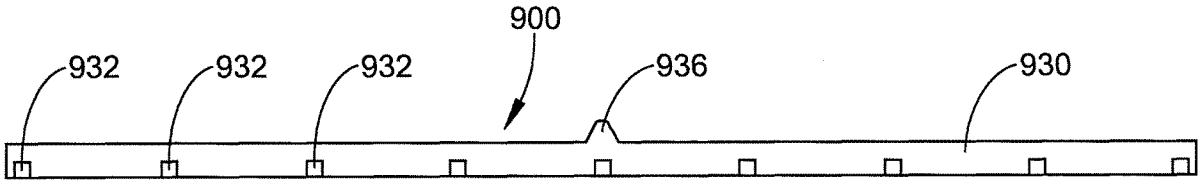
FIG. 9 is a side view of a retaining element of the embodiment of FIG. 1.
Figure 10:
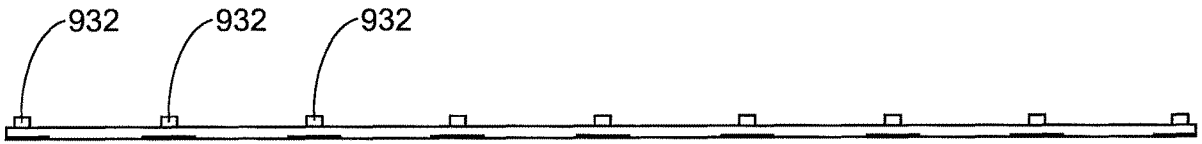
FIG. 10 is a bottom of the retaining element of FIG. 9.
Figure 11:
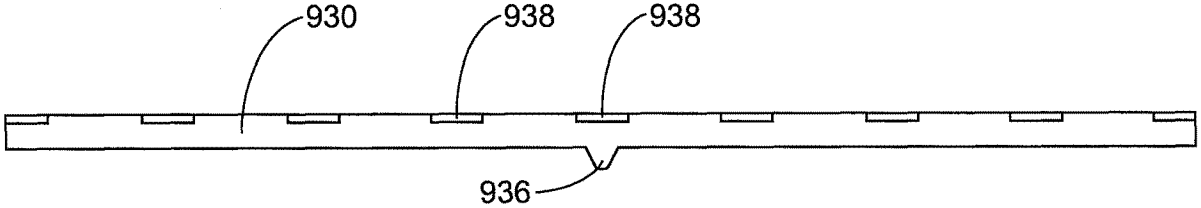
FIG. 11 is an opposite side view of the retaining element of FIG. 9.

FIGS. 7 and 8 show the front surface 610 with openings 690 and 690' as well as a top view of the vertical picket 130.

FIGS. 9-12 illustrate various views of the exemplary retaining element 900 of the present disclosure. A base portion 930 of the retaining element 900 includes a plurality of protrusions 932 extending along a length thereof. Protrusions 932 are configured to be received in openings 690/690' when the retaining element is positioned in a horizontal rail. The retaining element 900 further includes a tab 936 for positioning the retaining element 930 in the horizontal rail. The tab 936 also fixes the retaining element 900 within the horizontal rail to restrict sliding movement of the retaining element 900 relative to the horizontal rail, as will be described in detail below.

The retaining element 900 also includes a plurality of spaced-apart ribs 938 extending along a length thereof on a side opposite the protrusions 932. The ribs 938 make the insertion of the retaining element 900 easier and prevent deformation of the horizontal rails 120 as the retaining element is forced into horizontal rails 120 by relieving stress, for example.

Figure 12:
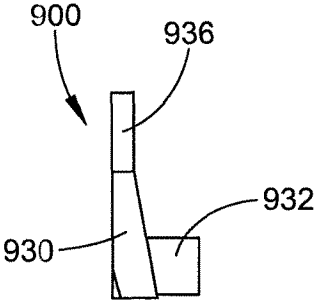
FIG. 12 is an end view of the retaining element of FIG. 9.

As shown in FIG. 12, the retaining element 900 has wedge-shape cross-section including opposite parallel upper and lower edges, a back (left) edge extending perpendicularly between the upper and lower parallel edges, and a front (right) edge extending at an acute angle relative to the back edge between the upper and lower parallel edges. The angled edge is configured to share a common angle with the downwardly angled edge 252 of the upper support ridge 250 such that when the retaining element 900 is positioned within the horizontal rail 120 the respective surfaces engage each other in abutting fashion.

Figure 13:
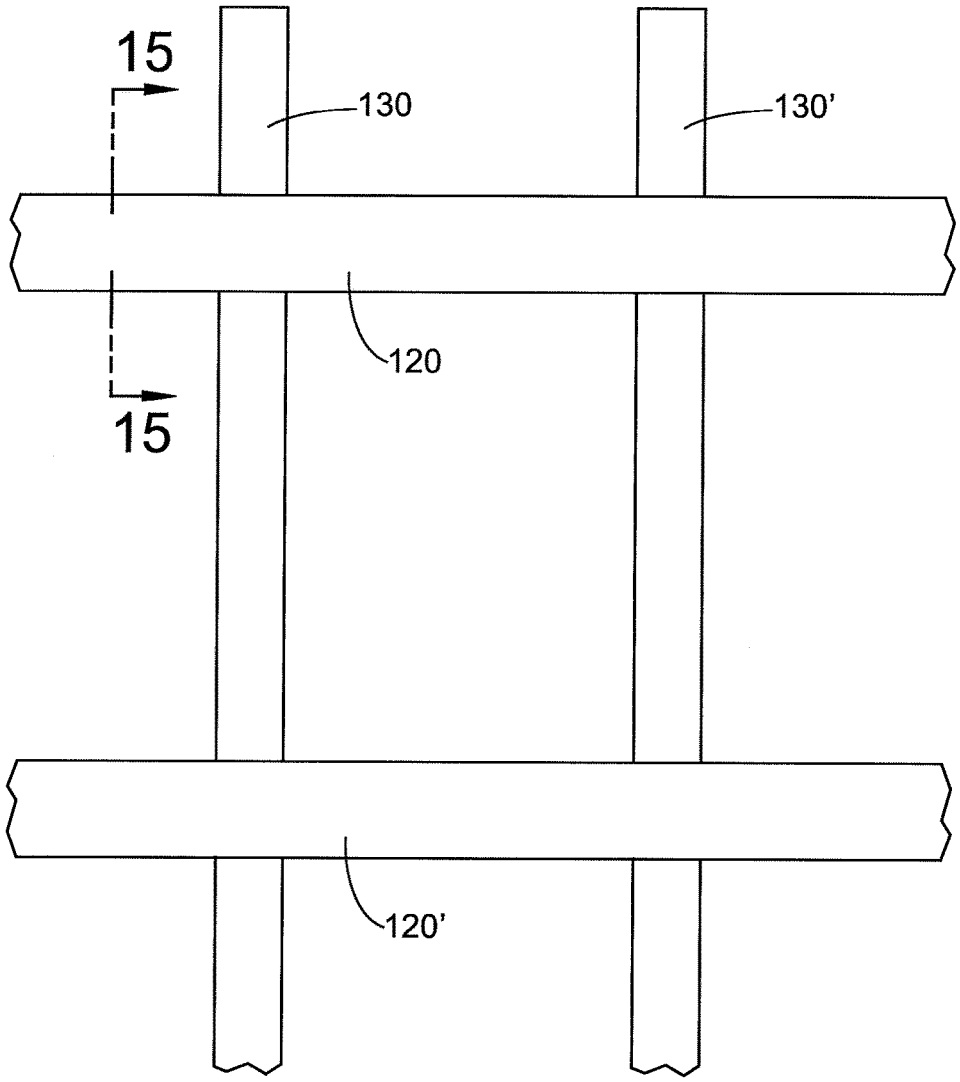
FIG. 13 is a detailed side view of the horizontal rail and vertical post of the embodiment of FIG. 1.

FIG. 13 is a detailed view of horizontal rails 120, 120' and vertical picket 130, 130' in an assembled state. Here, it is shown that the vertical pickets 130, 130' are located within horizontal rails 120, 120'. This is further shown in FIG. 14 where vertical pickets 130, 130' are located with apertures 210, 210' of the horizontal rail 120. The top surface 220, 220' and 220" is also shown in this figure.

Figure 15:
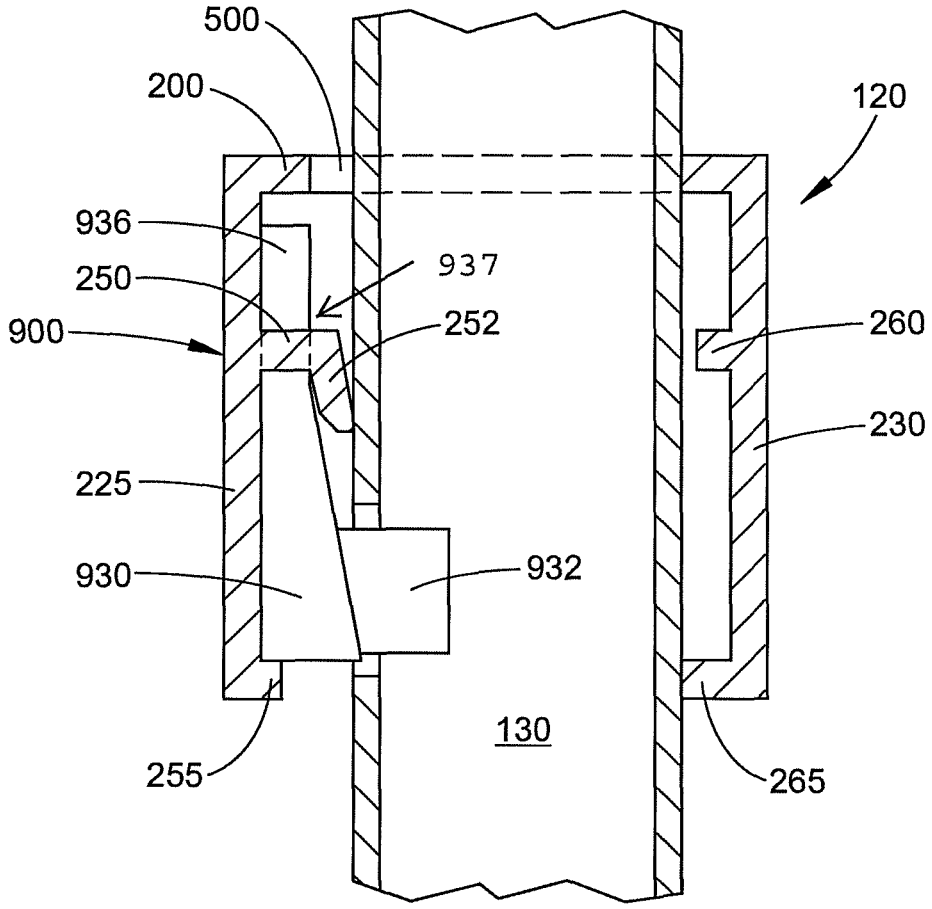
FIG. 15 is an end view of the horizontal rail and vertical post of FIG. 13 with retaining element.

FIG. 15 shows a detailed cross-section view of horizontal rail 120, vertical picket 130 and retaining element 900 of an embodiment of the present invention shown in FIG. 1. Here, vertical picket 130 and retaining element 900 are shown being located within aperture 210 of the horizontal rail 120. Retaining element 900 is shown located between upper support ridge 250 and lower support ridge 255. These support ridges hold or maintain the retaining element 900 in place against movement in a vertical direction in FIG. 15. The downwardly angled edge 252 prevents the retaining element 900 from raising up within the channel, or otherwise being dislodged. It fastens and stabilizes the retaining element 900 and eliminates its movement. The upper support ridge 250, angled edge 252, lower support ridge 255 and side face 225 form a four-sided open channel in which the retaining element is received.

Tab 936 is positioned in a slot or gap 937 between sections of upper support ridge 250. Tab 936 restricts movement of the retaining element 900 in a direction normal to the plane of FIG. 15. That is, tab 936 is trapped between adjacent sections of the upper support ridge 250 such that sliding movement relative to horizontal rail 120 is prevented. An exemplary embodiment showing such a gap in the upper support ridge 250 is shown in the drawings included in the Appendix.

Furthermore, vertical picket 130 is shown having its sides abut upper support ridge 260 and lower support ridge 265. Retaining element 900 is shown engaging or being engageable with vertical picket 130. Specifically, the protrusion 932 is engageable with opening 690 in vertical picket 130 (e.g., protrusion received in opening).

It will now be appreciated that retaining element 900 is fixed within horizontal rail 120, while the vertical pickets 130 are rotationally or pivotally engaged with the retaining element 900 to allow relative rotation between the horizontal rail 120 and the vertical pickets 130. This arrangement interlocks the picket to the rail while still permitting relative rotation when needed (e.g., as when installing fence on uneven ground).

Figure 17:
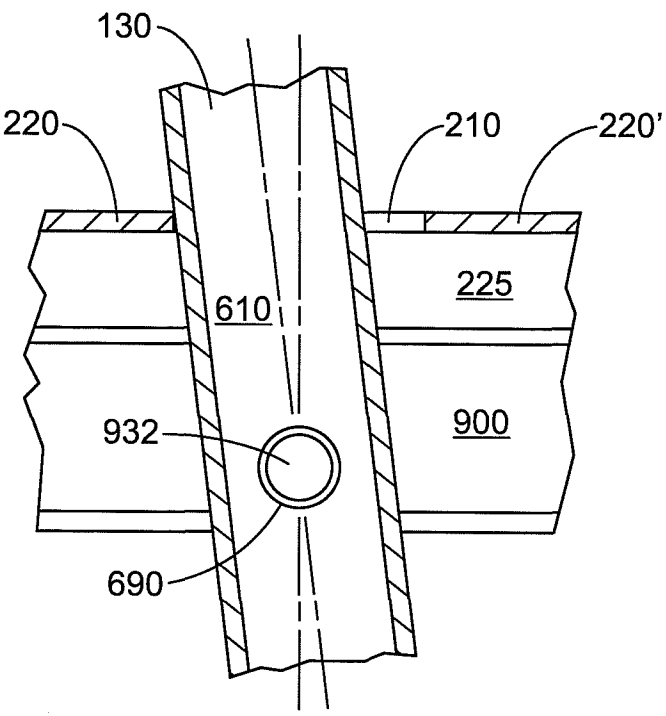
FIG. 17 is a detailed cross-sectional view of the horizontal rail, vertical post and retaining element assembly of FIG. 15 after being rotated.
Figure 16:
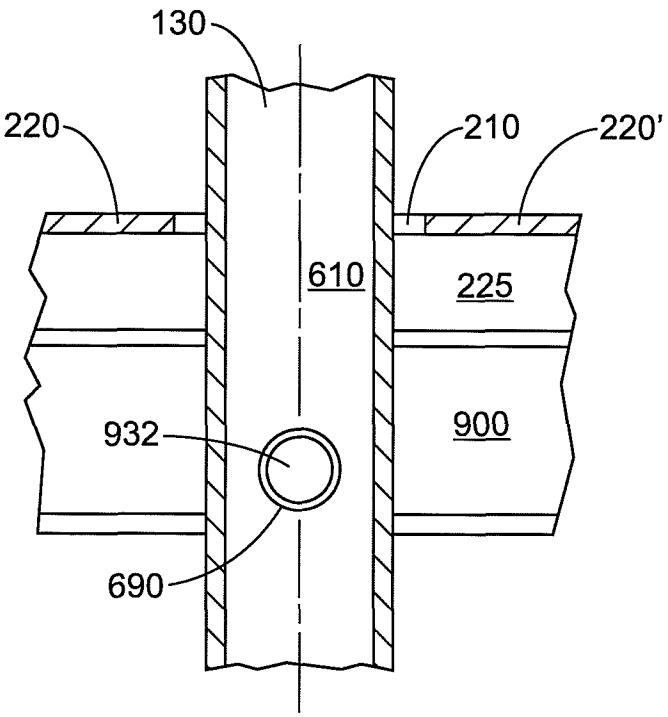
FIG. 16 is a top detailed cross-sectional view of the horizontal rail, vertical post and retaining element assembly of FIG. 15.

FIGS. 16 and 17 show the rotation of vertical picket 130 within horizontal rail 120. FIG. 16 shows vertical picket 130 being perpendicular to horizontal rail 120. FIG. 17 shows vertical picket 130 being rotated away from being perpendicular to horizontal rail 120. FIGS. 16-17 also show the face 610 of vertical picket 130 as well as other elements previously described in other figures. Allowing for the vertical picket 130 to rotate with respect to horizontal rail 120 is one of the objects of the invention as it allows the fence to rest on uneven surfaces. Moreover, such rotation is free and easy, through providing an advantage during assembly.

Figure 14:
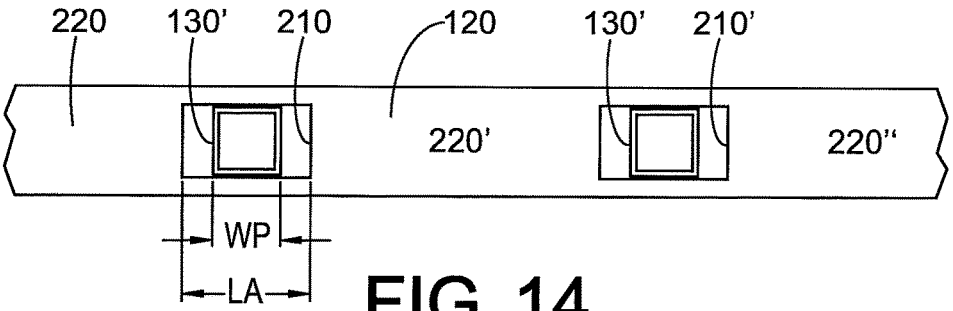
FIG. 14 is a top view of the horizontal rail and vertical post of FIG. 13.

As shown in FIG. 14, the length of the apertures LA can be, for example 1.5 times the width of the vertical pickets WP. The relative length of the aperture with respect to the width of the picket can at least in part determine the limits of rotation of the pickets relative to the rails. As shown in FIG. 17, maximum rotation of a picket is achieved when the picket contacts the surface of the horizontal rail defining the aperture.

Additional views of the above described exemplary embodiment, as well as drawings of additional embodiments and/or features in accordance with the present disclosure are included in the Appendix.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A fence comprising:

one or more horizontal rails, each of the one or more horizontal rails having one or more apertures extending through the one or more horizontal rails;

one or more vertical pickets, each of the one or more vertical pickets passing through the one or more apertures, each of the one or more vertical pickets having one or more openings and having one or more walls; and one or more retaining elements fixed within the one or more horizontal rails against sliding longitudinal movement within the one or more vertical pickets, each of the one or more retaining elements having a base portion and one or more protrusions, the one or more protrusions engaged with the one or more openings in the one or more vertical pickets to secure the one or more vertical pickets to the one or more horizontal rails;

whereby the one or more vertical pickets are fixed against vertical and horizontal movement relative to the one or more horizontal rails, and rotatable relative to the one or more horizontal rails.

2. The fence as set forth in claim 1, wherein the one or more vertical pickets are rotatable relative to the one or more horizontal rails, the extent of said rotation being limited by interference with portions of the one or more horizontal rails surrounding the one or more apertures.

3. The fence as set forth in claim 2, wherein the one or more apertures are rectangular apertures having a length along the longitudinal direction of the horizontal rail that is greater than a width of the one or more vertical pickets.

4. The fence as set forth in claim 1, wherein the length of the one or more apertures is at least 1.5 times the width of the one or more vertical pickets.

5. A fence comprising:

one or more horizontal rails, each of the one or more horizontal rails having one or more apertures extending through the one or more horizontal rails;

one or more vertical pickets, each of the one or more vertical pickets passing through the one or more apertures, each of the one or more vertical pickets having one or more openings and having one or more walls; and one or more retaining elements fixed within the one or more horizontal rails against sliding longitudinal movement within the one or more vertical pickets, each of the one or more retaining elements having a base portion and one or more protrusions, the one or more protrusions engaged with the one or more openings in the one or more vertical pickets to secure the one or more vertical pickets to the one or more horizontal rails;

whereby the one or more vertical pickets are fixed against lateral and horizontal movement relative to the one or more horizontal rails, and rotatable relative to the one or more horizontal rails;

wherein the one or more horizontal rails include a first support ridge extending along a length thereof, the support ridge having a gap therein, and wherein the retaining element includes a tab that is received in the gap thereby restricting longitudinal displacement of the retaining element relative to the horizontal rail.

6. The fence as set forth in claim 5, wherein the one or more horizontal rails include a second support ridge extending along a length thereof and spaced apart from the first support ridge, and wherein the retaining element is received between the first and second support ridges along a major portion of its length, whereby the retaining element is restricted from transverse movement relative to the horizontal rail.

7. The fence as set forth in claim 6, wherein the first support ridge includes a first portion extending perpendicular from the horizontal rail, and a distal angled edge portion extending from the first portion in a direction towards the second support ridge, whereby the distal angled edge portion traps the retaining member against an adjacent surface of the horizontal rail.

8. The fence as set forth in claim 7, wherein at least a portion of the retaining element has a wedge-shape cross-section including opposite parallel edges, a back edge extending perpendicularly between said opposite parallel edges, and a front edge extending at an acute angle relative to the back edge between said opposite parallel edges.

9. The fence as set forth in claim 8, wherein the front edge of the retaining element extends at a common angle with the distal angled edge portion of the first support ridge.

10. The fence as set forth in claim 9, wherein the front edge portion and the distal angled edge portion of the first support ridge are coextensive.

11. A method of installation of a modular fence comprising the steps of:

providing one or more horizontal rails, each of the one or more horizontal rails having one or more apertures extending through the one or more horizontal rails;

providing one or more vertical pickets, each the one or more vertical pickets having one or more openings;

providing one or more retaining elements, each of the one or more retaining elements having a base portion with one or more protrusions and a tab;

disposing each of the one or more vertical pickets through one of the apertures extending through the one or more horizontal rails;

disposing the one or more retaining elements within the one or more horizontal rails with the tab positioned in a gap of a support ridge of the one or more horizontal rails; and engaging the one or more protrusions of the one or more retaining elements with the one or more openings in the one or more vertical pickets to fix the one or more vertical pickets to the one or more horizontal rails while permitting relative rotation between one or more horizontal rails and the one or more vertical pickets.

12. The method of claim 11, wherein the one or more horizontal rails include a first support ridge extending along a length thereof, the support ridge having a gap therein, and wherein the retaining element includes a tab that is received in the gap thereby restricting longitudinal displacement of the retaining element relative to the horizontal rail.

13. The method of claim 12, wherein the one or more horizontal rails include a second support ridge extending along a length thereof and spaced apart from the first support ridge, and wherein the retaining element is received between the first and second support ridges along a major portion of its length, whereby the retaining element is restricted from transverse movement relative to the horizontal rail.

14. The method of claim 13, wherein the first support ridge includes a first portion extending perpendicular from the horizontal rail, and a distal angled edge portion extending from the first portion in a direction towards the second support ridge, whereby the distal angled edge portion traps the retaining member against an adjacent surface of the horizontal rail.

15. The method of claim 14, wherein at least a portion of the retaining element has a wedge-shape cross-section including opposite parallel edges, a back edge extending perpendicularly between said opposite parallel edges, and a front edge extending at an acute angle relative to the back edge between said opposite parallel edges.

16. The method of claim 15, wherein the front edge of the retaining element extends at a common angle with the distal angled edge portion of the first support ridge.

* * * * *